United States Patent [19]

Mizukami et al.

[11] 4,188,565

[45] Feb. 12, 1980

[54] OXYGEN ATOM CONTAINING FILM FOR A THIN-FILM ELECTROLUMINESCENT ELEMENT

[75] Inventors: Etsuo Mizukami, Tenri; Hiroshi Kishishita; Masashi Kawaguchi, both of Nara; Yoshihiro Endo, Osaka; Kinichi Isaka, Tenri, all of Japan

[73] Assignee: Sharp Kabushiki Kaisha, Osaka, Japan

[21] Appl. No.: 884,475

[22] Filed: Mar. 8, 1978

[30] Foreign Application Priority Data

Sep. 16, 1977 [JP] Japan ..... 52/112018
Oct. 11, 1977 [JP] Japan ..... 52/122084

[51] Int. Cl.[2] ..... H05B 33/02; H05B 33/22
[52] U.S. Cl. ..... 313/509
[58] Field of Search ..... 313/509

[56] References Cited

U.S. PATENT DOCUMENTS

| | | | |
|---|---|---|---|
| 3,037,138 | 5/1962 | Motson | 313/509 X |
| 3,806,759 | 4/1974 | Kabaservice et al. | 313/506 X |
| 3,854,070 | 12/1974 | Vlasenko et al. | 313/509 X |
| 4,024,389 | 5/1977 | Kanatani et al. | 313/509 X |

FOREIGN PATENT DOCUMENTS

| | | | |
|---|---|---|---|
| 51-55685 | 5/1976 | Japan | 313/509 |

*Primary Examiner*—Palmer C. Demeo
*Attorney, Agent, or Firm*—Birch, Stewart, Kolasch & Birch

[57] ABSTRACT

At least one silicon-oxynitride film is deposited on an electroluminescence layer for providing a uniform and stable dielectric layer for an electroluminescence display panel. The silicon-oxynitride film is deposited using a sputtering technique by mixing a small amount (1 mol%) of nitrous oxide ($N_2O$) gas into a sputtering gas such as nitrogen ($N_2$) gas. Oxygen ($O_2$) gas may be substituted for the $N_2O$ gas mingled within the sputtering gas in the amount of five mol%. A target for sputtering is a pure silicon or sintered $Si_3N_4$ plate. An R.F. discharge is provided so that the power flux density on the target becomes several to several ten W. The silicon-oxynitride film is derived by means of the reaction between ion sputtering and the sputtering gas. A dielectric layer is further provided for establishing high reliabiltiy high dielectric properties of the electroluminescence display panel, the dielectric layer being disposed together with the silicon-oxynitride film and being one of the group consisting of $Al_2O_3$, $SiO_2$, $Ta_2O_5$, $Si_3N_4$ and $Y_2O_3$. The silicon-oxynitride flm which is injected by suitable ions such as $P^+$, $H^+$, $He^+$, $Ne^+$, or $Ar^+$ may be further provided as the dielectric layer.

14 Claims, 3 Drawing Figures

OXYGEN ATOM CONTAINING FILM FOR A THIN-FILM ELECTROLUMINESCENT ELEMENT

BACKGROUND OF THE INVENTION

The present invention relates to a thin-film electroluminescence (EL) matrix display panel, which includes an EL thin layer sandwiched between a pair of dielectric layers and, more particularly, a novel construction of the EL matrix display panel.

$Si_3N_4$ films have been formed on an electroluminescence layer made of a ZnS thin-film doped with manganese for functioning dielectric layers of the thin-film EL matrix display panel to thereby stabilize the dielectric properties thereof. The $Si_3N_4$ films are composed by conventional sputtering techniques. However, there are defects in providing the $Si_3N_4$ film that the $Si_3N_4$ film has unavoidably little adhesion force to the ZnS thin-film and, random surface levels are inevitably produced because of a small inconsistency of the $Si_3N_4$ film surface conditions. It has been postulated as reasons thereof by the present inventors that the little adhesion results from providing the adhesion thereof in accordance with van der Waals' force to heterofilms and detaching the $Si_3N_4$ film from the ZnS thin-film by means of pin holes or impurities erroneously disposed on the interface thereof. The random surface levels result in making the electroluminescence initiating voltage non-controllable to thereby produce nonuniform electroluminescence. To eliminate the above defects, it has been required that the $Si_3N_4$ films are provided under very clean conditions for the fabrication thereof. However, such clean conditions necessitate expensive manufacturing apparatus. Planar diode sputtering techniques are usefully available for forming the $Si_3N_4$ films because the planar diode sputtering techniques enhance the clean conditions of the substrate surfaces and permit the generation of films by means of secondary emission from the target thereof.

Recently, planar magnetron sputtering techniques have been utilized for the planar diode sputtering techniques. Unfortunately, in the planar magnetron sputtering techniques a small amount of secondary emission is obtained so that enhancement of the clean conditions in terms of the secondary emission is not expected. In other words, the planar magnetron sputtering techniques are not suitable for fabricating wide thin-film EL matrix display panels since films formed by the planar magnetron sputtering techniques are inferior in adhesion properties and uniformity thereof.

OBJECTS AND SUMMARY OF THE INVENTION

Accordingly, an object of the present invention is to provide a novel construction of the EL matrix display panel which includes a homogeneous and stable dielectric layer.

Another object of the present invention is to provide novel fabrication methods for the EL matrix display panel.

Still another object of the present invention is to provide the novel EL matrix display panel which produces uniform electroluminescence over a wide electroluminescense layer thereof.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a silicon-oxynitride film is provided on an electroluminescence layer to function as dielectric layer thereof, the silicon-oxynitride film comprising a $Si_3N_4$ film doped with a very small amount of oxygen atoms. In a preferred form the silicon-oxynitride film includes the oxygen atoms in an amount of about 0.1 to 10% under the conditions that nitrous oxide ($N_2O$) gas is introduced into the sputtering gas in a small amount of 0.1 to 2.0%.

In another preferred form, two dielectric films including one silicon-oxynitride film are provided on one side of the electroluminescence layer and another two dielectric films including one silicon-oxynitride film are formed on another side of the electroluminescence layer.

In still another preferred form, one silicon-oxynitride film is formed between the electroluminescence layer and a transparent electrode. Another silicon-oxynitride film may be disposed between an insulative layer and the electroluminescence layer.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Preliminary to a detailed discussion of the present invention in general, it may be of advantage to outline the structure of a basic structure of a prior art EL matrix display panel.

Figure 1:
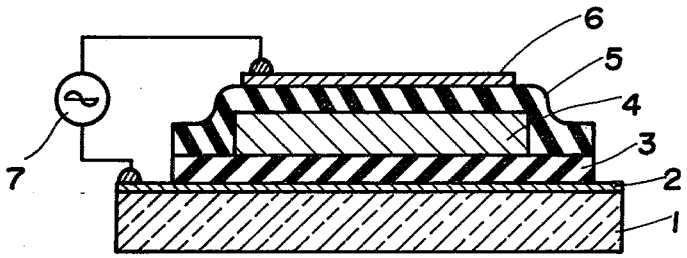
FIG. 1 is a cross sectional view of a basic structure of a prior art EL matrix display panel.

Referring now to FIG. 1 of the drawings, the prior art EL matrix display panel comprises a flat glass substrate 1, a plurality of transparent, parallel line electrodes 2 made of $In_2O_3$ or $SnO_2$ thereon, two dielectric films 3 and 5 both made of $Y_2O_3$, $Si_3N_4$, or $SiO_2$, an electroluminescence (EL) layer 4 made of a ZnS thin-film doped with manganese therebetween, and a plurality of counter, parallel line electrodes 6 made of Al on the dielectric film 5. These dielectric layers 3 and 5 are formed through the use of evaporation techniques or sputtering methods to the thickness of 500–10000 Å. The parallel line electrodes 2 and 6 cross each other at a right angle. The EL layer 4 is fabricated by evaporating a ZnS sintered pellet doped with Mn at a preferable quantity, the Mn serving as a luminescent center in the EL layer 4.

An AC power source 7 is applied between the parallel line electrodes 2 and 6 to cause the EL layer 4 to produce an electroluminescence. Although the dielectric layers 3 and 5 require high specific inductive capacity thereof sufficient for enlarging the effective field strength applied to the EL layer 4, it has been only available for the dielectric layers made of SiO, $SiO_2$, $GeO_2$, $Y_2O_3$, $Al_2O_3$, or $Ta_2O_5$ etc. owing to manufacturing restrictions thereof. However, the dielectric layers made of the above material are not constant in dielectric characteristics in accordance with the fabrication conditions thereof. Defects in this dielectric layer are summarized as follows: increase of generation of pin holes on account of strong crystallization thereof; reduction of applied voltage owing to crystal grain thereof; nonuniform brightness of the electro-luminescence; crystal shear thereof; the reduction of packing density thereof; and the generation of microcracks therein.

To overcome the above defects in the conventional dielectric layer, a $Si_3N_4$ film has been recently utilized for the above dielectric layer, the $Si_3N_4$ film being amorphous.

The $Si_3N_4$ film as the dielectric layers 3 and 5 are usually formed using conventional sputtering methods and are recognized that they are one of the dielectric films suitable for the EL matrix display panel because of having the high applied voltage.

However, but further problems still remain in the $Si_3N_4$ film that only small adhesion thereof is expected and random surface levels are unavoidably obtained. The small adhesion results from depending on the van der Waals' force of the $Si_3N_4$ film in the adhesion between heterogeneous films because the $Si_3N_4$ film includes no atom which has an electronic bond, for example, an oxygen atom and, therefore, dirt, pin holes, and impurities erroneously disposed on the interface between the heterogeneous films cause detachment therebetween. The random surface levels are caused by slight surface condition inconsistencies to thereby result in an uncontrolled luminescence initiating voltage over the luminescence layer and provide random luminescence brightness. It is required in order to eliminate the above defects that there are provided $Si_3N_4$ films under very clean conditions and flatness of the surface of the substrates therefor and such fabrication requirement is difficult for a mass production system since the fabrication requirement therefor is expensive.

In diode sputtering methods, secondary emission enhances the clean conditions and the flatness as the secondary emission provides not only heat to the substrate thereof but also bias potential in accordance with the accumulation of minus charge. The volume of the bias potential depends on the sputtering conditions but extends to about several tens of kilovolts. In terms of the bias potential a reverse sputtering effect is employed to thereby enhance the clean conditions and the flatness of the interface therebetween.

Recently, a planar magnetron system has been utilized for the diode sputtering system. However, the planar magnetron system can not enhance the clean conditions and the flatness of the interface because only a small amount of the secondary emission is produced. The planar magnetron system is not available for fabricating the EL matrix display panel since films provided by the planar magnetron system have little adhesion and uniformity of the interface, thereby producing irregular luminescence of the EL matrix display panel and reducing the life time thereof.

Figure 2:
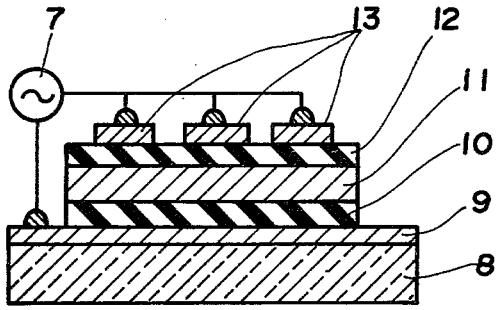
FIG. 2 is a cross sectional view of an embodiment of an EL matrix display panel of the present invention.

FIG. 2 illustrates the EL matrix display panel in a preferable form of the present invention. The EL matrix display panel comprises the flat glass substrate 8 made of 7059 Pyrex chemical resistant glass, a plurality of transparent, parallel line electrodes 9 made of $In_2O_3$ or $SnO_2$ in a thickness of 1400–1500 Å thereon, two silicon-oxynitride films 10 and 12, the EL layer 11 made of the ZnS thin-film doped with manganese therebetween, and a plurality of counter, parallel line electrodes 13 made of Al on the silicon-oxynitride film 12. The parallel line electrodes 9 and 13 cross each other at a right angle. The EL layer 11 is fabricated with the thickness, for example, of 0.01–20 μm by evaporating under pressure of $10^{-7}$–$10^{-3}$ torr a ZnS sintered pellet doped with Mn in a preferable quantity, the Mn serving as the luminescent center in the EL layer 11. Memory behaviors emerge at MN concentrations above 0.5% by weight and are enhanced in accordance with increase in the Mn concentration. Details of the memory behavior are disclosed in U.S. Pat. No. 4,024,389 assigned to the present assignee. The AC power source 7 is applied between the parallel line electrodes 9 and 13 to cause the EL layer 11 to produce the electroluminescence.

The silicon-oxynitride films 10 and 12 with the thickness of 0.1–10 μm comprise the $Si_3N_4$ film doped with a very small amount of oxygen atoms by introducing a small amount below 1% of nitrous oxide ($N_2O$) gas into a sputtering gas of $10^{-2}$–$10^{-3}$ mmHg, such as $N_2$ gas, or the combination of $N_2$ gas and Ar gas. The $Si_3N_4$ film is provided in accordance with conventional reactive sputtering techniques under the condition that the sputtering gas is selected $N_2$ gas, or the combination of $N_2$ gas and Ar gas, and an R.F. discharge is effected at a power flux density of several tens of watts at a silicon target which is pure polysilicon or sintered $Si_3N_4$ plate. The $Si_3N_4$ film is formed by the reaction between the sputtered ions and the $N_2$ gas. The $Si_3N_4$ film is characterized in that permittivity $\epsilon=7$–9, dielectric loss tan $\delta=0.002$–0.003 (1 KHz), and applied voltage $E_B=6$–$7\times10^6$ V/cm. The silicon-oxynitride films 10 and 12 are provided by sputtering the silicon target under the sputtering gas including a small amount of the nitrous oxide ($N_2O$) gas. Since the activity of the oxygen gas is much greater than that of the nitrogen gas, the amount of the oxygen gas mingled in the silicon-oxynitride films 10 and 12 is much greater than that of the sputtering gas. In a preferred form, the oxygen gas is mixed in the silicon-oxynitride films 10 and 12 in an amount of 0.1 to 10 atm%. The silicon-oxynitride films 10 and 12 provide adhesion derived from not only the van der Waals' forces of the $Si_3N_4$ films but also the electronic bond of the oxygen atoms. The generation of the surface levels is reduced by means of uniform surface conditions. Appropriate control of the amount of the nitrous oxide ($N_2O$) gas provides no change of electronic properties and amorphous characteristics of the $Si_3N_4$ film. If the nitrous oxide is mixed in the sputtering gas in an amount above five mol%, a film including $SiO_2$ or a silicon film may be derived to thereby reduce permittivity and generate a crystallic layer. By this reason it is preferable that the nitrous oxide ($N_2O$) gas is mixed within the sputtering gas in an amount of 0.1 to 2.0 mol% in relation to the sputtering conditions. $SiN_4$, $Ta_2O_5$, or $Y_2O_3$ may be substituted for the silicon-oxynitride film 12.

Figure 3:
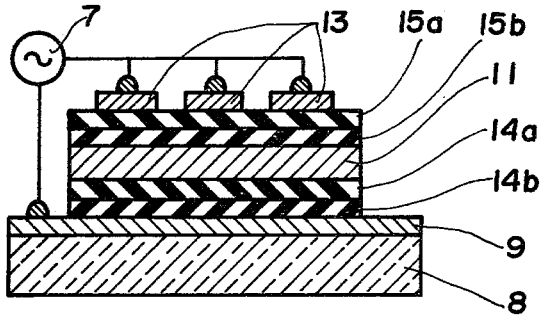
FIG. 3 is a cross sectional view of another embodiment of the EL matrix display panel of the present invention.

FIG. 3 shows a cross sectional view of another embodiment of the EL matrix display panel of the present invention. Like elements corresponding to those of FIG. 2 are indicated by like numerals.

Both or either of first and second dielectric layers **14*a* and 14*b*, and another first and second dielectric layers 15*a* and 15*b* may be provided on the EL layer 11 to achieve high reliability and strong dielectric properties of the EL matrix display panel. The first dielectric layer 14a is the silicon-oxynitride film and the second dielectric layer 14b comprises $SiO_2$ with the thickness of 50 Å to 600 Å. Another first dielectric layer 15a is $Al_2O_3$ and another second dielectric layer 15b is the silicon-oxynitride film. Furthermore, the first and second dielectric layers 14a and 15b are the silicon-oxynitride films, and the first and second dielectric layers 15a and 14b comprise $Ta_2O_5$. Moreover, the first dielectric layer 15a** comprises the silicon-oxynitride film which is injected by suitable ions such as $P^+$, $H^+$, $He^+$, $Ne^+$, or $Ar^+$ in an amount of $10^{14}-5\times10^{16}/cm^2$, under the acceleration energy of 20–300 KeV at room temperature.

The combination of the dielectric layers 10, 12, 14a, 14b, 15a and 15b is summarized through the embodiments shown in FIGS. 2 and 3 as follows:

TABLE 1

| 12 | | 10 | |
|---|---|---|---|
| 15a | 15b | 14a | 14b |
| silicon-oxynitride | | silicon-oxynitride | |
| Injected silicon-oxynitride | silicon-oxynitride | silicon-oxynitride | |
| $Al_2O_3$ | silicon-oxynitride | silicon-oxynitride | $SiO_2$ |
| $Ta_2O_5$ | silicon-oxynitride | silicon-oxynitride | $Ta_2O_5$ |
| $Si_3N_4$ | | silicon-oxynitride | |
| $Ta_2O_5$ | | silicon-oxynitride | |
| $Y_2O_3$ | | silicon-oxynitride | |

The silicon-oxynitride film is ion-injected so that the dielectric properties thereof are enhanced. The dielectric film made of $Ta_2O_5$ or $Al_2O_3$ protects the EL layer 11 from the emvironment, especially moisture because of the high permittivity thereof.

Although it has been described that the sputtering gas is nitrous oxide ($N_2O$), any desirable oxide gas or oxygen gas is available in place of the nitrous oxide ($N_2O$) gas. In such a way, it is preferable that the oxygen gas be mixed within the sputtering gas in an amount below 5 mol%.

Suitable dielectric films may be substituted for the $Si_3N_4$ film though only a $Si_3N_4$ film is described above.

The invention being thus described, it will be obvious that the same may be varied in mahy ways. Such variations are not to be regarded as a departure from the spirit and scope of the invention, and all such modifications are intended to be included within the scope of the following claims.

What is claimed is:

1. A thin-film electroluminescent element comprising:

a thin-film electroluminescent layer including a luminescent center;

first and second dielectric layers, said electroluminescent layer being disposed between said dielectric layers, at least one of said dielectric layers containing oxygen in the atomic state which provides a bonding force between the dielectric layer and the thin-film electroluminescent layer; and first and second electrodes provided on said dielectric layers, respectively.

2. The thin-film electroluminescent element according to claim 1, wherein at least one of said dielectric layers is silicon-oxynitride.

3. The thin-film electroluminescent element according to claim 2, wherein a further dielectric layer different from said silicon-oxynitride layer is provided on at least one of said dielectric layers.

4. The thin-film electroluminescent element according to claim 3, wherein the further dielectric layer is $SiO_2$, $Ta_2O_5$, $Al_2O_3$, $Si_3N_4$ or $Y_2O_3$.

5. The thin-film electroluminescent element according to claim 1, wherein at least one of said dielectric layers is formed directly on said electroluminescent layer.

6. The thin-film electroluminescent element according to claim 1, wherein at least one of said first and second dielectric layers comprises a silicon-oxynitride film containing a predetermined amount of ions selected from the group consisting of $P^+$, $H^+$, $He^+$, $Ne^+$ and $Ar^+$.

7. The thin-film electroluminescent element according to claim 1, the dielectric layer containing oxygen in the atomic state being produced by sputtering a silicon target with a sputtering gas containing nitrous oxide ($N_2O$) gas, oxygen ($O_2$) gas or an oxide gas.

8. The thin-film electroluminescent element according to claim 7, wherein nitrous oxide gas is mixed within said sputtering gas in an amount of 0.1 to 2.0 mol %.

9. The thin-film electroluminescent element according to claim 7, wherein oxygen gas is mingled within said sputtering gas in an amount below 5 mol %.

10. The thin-film electroluminescent element according to claim 1, wherein at least one of said dielectric layers contains oxygen atoms in an amount of 0.1 to 10 atm %.

11. A thin-film electroluminescent element comprising:

a thin-film electroluminescent layer including a luminescent center;

first and second dielectric layers, said electroluminescent layer being disposed between said dielectric layers, each of said dielectric layers being composed of two stacked heterogeneous dielectric layers, at least one of said dielectric layers containing oxygen in the atomic state which provides a bonding force between the dielectric layer and the thin-film electroluminescent layer; and first and second electrodes provided on said dielectric layers, respectively.

12. The thin-film electroluminescent element according to claim 11, wherein the heterogeneous dielectric layers comprise said oxygen-containing layer and a dielectric material selected from the group consisting of $SiO_2$, $Ta_2O_5$, $Al_2O_3$, $Si_3N_4$ and $Y_2O_3$.

13. The thin-film electroluminescent element according to claim 11, wherein said oxygen-containing layer is silicon-oxynitride.

14. The thin-film electroluminescent element according to claim 13, wherein the silicon-oxynitride layer contains a predetermined amount of ions selected from the group consisting of $P^+$, $H^+$, $He^+$, $Ne^+$ and $Ar^+$.

* * * * *